US010488111B2

(12) United States Patent
Ferreira Filho et al.

(10) Patent No.: US 10,488,111 B2
(45) Date of Patent: Nov. 26, 2019

(54) METALLURGICAL FURNACE FOR PRODUCING METALLIC ALLOYS

(71) Applicant: TECNORED DESENVOLVIMENTO TECHNOLÓGICO S.A., Pindamonhangaba-SP (BR)

(72) Inventors: Hermes Joaquim Ferreira Filho, São Paulo (BR); Kleiton Gonçalves Lovati, São Paulo (BR); Luciano Augusto Morais Maia, São Paulo (BR); André Silva da Luz, São Paulo (BR); Geovane Viturino da Silva, São Paulo (BR); Roberto Okada Junior, São Paulo (BR)

(73) Assignee: Tecnored Desenvolvimento Tecnologico S.A., São Paulo (BR)

( * ) Notice: Subject to any disclaimer, the term of this patent is extended or adjusted under 35 U.S.C. 154(b) by 235 days.

(21) Appl. No.: 15/537,155

(22) PCT Filed: Nov. 9, 2015

(86) PCT No.: PCT/BR2015/050209
§ 371 (c)(1),
(2) Date: Jun. 16, 2017

(87) PCT Pub. No.: WO2016/094994
PCT Pub. Date: Jun. 23, 2016

(65) Prior Publication Data

US 2017/0343285 A1 Nov. 30, 2017

(30) Foreign Application Priority Data

Dec. 16, 2014 (BR) ..... 020140314873
Mar. 11, 2015 (BR) ..... 102015005373

(51) Int. Cl.
*F27B 1/02* (2006.01)
*C21B 11/02* (2006.01)
(Continued)

(52) U.S. Cl.
CPC ..... *F27B 1/02* (2013.01); *C21B 11/02* (2013.01); *C21B 13/02* (2013.01); *F27B 1/16* (2013.01)

(58) Field of Classification Search
CPC ..... F27B 1/02; F27B 1/20
See application file for complete search history.

(56) References Cited

U.S. PATENT DOCUMENTS 3,543,955 A * 12/1970 Shekels ..... C21B 7/20 266/122
5,759,232 A * 6/1998 Takahashi ..... F27B 1/20 266/176

(Continued)

FOREIGN PATENT DOCUMENTS

BR 9403502 A 9/1996
BR PI94035024 9/1996

(Continued)

OTHER PUBLICATIONS

International Search Report for PCT/BR2015/050209 dated Feb. 4, 2016, 3 pages.

(Continued)

*Primary Examiner* — Scott R Kastler
(74) *Attorney, Agent, or Firm* — Reising Ethington, P.C.

(57) ABSTRACT

The instant invention relates to a metallurgical furnace, comprising at least one upper stack (1), at least one lower stack (2), at least one fuel feeder positioned substantially between at least one upper stack (1) and the at least one lower stack (2), at least one row of tuyères (3, 4) positioned in at least one of the at least one upper stack (1) and at least (Continued)

one lower stack (2), the at least one row of tuyères (3, 4) providing a fluid communication between the inside of the furnace and the external environment, positioned in at least one of at least one upper stack (1) and at least one lower stack (2), and further comprising at least one permeabilizing fuel column fed through at least one hood (6), placed in the upper stack (1), which extends longitudinally through the furnace.

7 Claims, 2 Drawing Sheets

(51) Int. Cl.
*C21B 13/02* (2006.01)
*F27B 1/16* (2006.01)

(56) References Cited

U.S. PATENT DOCUMENTS

| | | | | |
|---|---|---|---|---|
| 6,517,603 | B2 | 2/2003 | Contrucci | |
| 6,692,688 | B2 | 2/2004 | Contrucci et al. | |
| 2002/0134199 | A1 | 9/2002 | Contrucci et al. | |
| 2002/0135109 | A1 | 9/2002 | Contrucci et al. | |
| 2017/0343285 | A1* | 11/2017 | Ferreira Filho ..... | F27B 1/16 |

FOREIGN PATENT DOCUMENTS

| | | | |
|---|---|---|---|
| CN | 1498278 | A | 5/2004 |
| CN | 1545562 | A | 11/2004 |
| RU | 2299244 | C2 | 5/2007 |
| WO | WO02075001 | A2 | 9/2002 |

OTHER PUBLICATIONS

English Translation of International Search Report for PCT/BR2015/050209 dated Feb. 4, 2016, 2 pages.
Extended European Search Report for PCT/BR2015/050209, dated Jun. 26, 2018, 7 pages.
English Translation of the Search Report Application No. 201580075971.5, dated Aug. 27, 2018, 2 pages.
First Notification of Office Action from Chinese Patent Office Application No. 201580075971.5, dated Sep. 4, 2018, 6 pages.
English Translation of First Notification of Office Action Cover Pages from Chinese Patent Office Application No. 201580075971.5, dated Sep. 4, 2018, 3 pages.
English Translation of First Notification of Office Action and Comments Application No. 201580075971.5, 6 pages.
Russian Search Report for Application No. 2017125002 dated Dec. 14, 2018, 2 pages.
Russian Office Action for Application No. 2017125002 dated Dec. 17, 2018, 4 pages.
English Translation of Russian Office Action for Application No. 2017125002 dated Dec. 17, 2018, 5 pages.
Ukranian Office Action for Application No. A 2017 07400 dated Feb. 15, 2019, 4 pages.
English Translation of Ukranian Office Action for Application No. A 2017 07400 dated Feb. 15, 2019, 3 pages.
Notification of Second Office Action from Chinese Patent Office for Application No. 201580075971.5, dated Apr. 4, 2019; 4 pages.
English Translation of Notification of Second Office Action from Chinese Patent Office for Application No. 201580075971.5, dated Apr. 4, 2019; 3 pages.

* cited by examiner

METALLURGICAL FURNACE FOR PRODUCING METALLIC ALLOYS

TECHNICAL FIELD

The instant disclosure relates to metallurgical processes and apparatuses. More particularly, the instant disclosure is related to metallurgical processes and apparatuses for producing metallic alloys.

DESCRIPTION OF THE STATE OF THE ART

Classic processes to produce pig iron are already known, which can be carried out, for example, in blast furnaces and electrical reduction furnaces. Other processes for producing alloys from iron oxide or iron ore after granulometric conditioning, classic pellets or other traditional agglomerates are also known, obtaining by traditional operations in these furnaces liquid or solid iron of a certain composition.

In blast furnaces, the filler which may be composed of sorted ore, pellets, sinter or other classical agglomerates, coke and limestone are charged sequentially through the top of the furnace, forming a continuous column. At the bottom of the blast furnace is introduced atmospheric air, preheated in regenerative heaters or not, at an approximate temperature of 300 to 1200° C., through a row of tuyères in the upper part of a crucible. At this site, a zone with reducing atmosphere is formed due to the presence of carbon monoxide, formed by the reaction of the $CO_2$ with the carbon of the coke. This CO combines with oxygen from iron oxide, reducing it to metallic iron and producing pig iron.

Impurities, that is, ore gangue and coke ashes form with the limestone a liquid, less dense, slag that floats on the surface of the cast pig iron.

The gases formed in countercurrent with the filler preheat it and exit from the top. This gas consists mainly of CO, $CO_2$, $H_2$ and $N_2$ and is conducted to the regenerative preheaters of the combustion air entering the furnace and other heating devices.

It is also known that, in the filler consisting of classified ore, pellets, sinter or other classic agglomerates reduction is performed by the reduction of the oxidized filler by the CO generated from the partial combustion of the coke. CO diffuses inside the agglomerate or the ore particles, and the reduction according to the reaction $MeO+CO \rightarrow Me+CO_2$ occurs. $CO_2$ generated in this reaction spreads in the opposite direction to CO and is incorporated into the gas stream that exits the furnace from the top. This reaction demands a certain time for the complete diffusion of CO inside the filler, thus requiring furnaces with high residence times of filler inside, as are typically the blast furnaces.

The self-reducing agglomerates, on the other hand, present conditions much more favorable to the reduction. The closest contact between the ore or oxide and the carbonaceous material, which are finely divided, provides a shorter reaction time in that there is no need for the diffusion stage of CO into the self-reducing agglomerate, pre-built inside the agglomerates for this purpose:

$$2MeO+C \rightarrow 2Me+CO_2$$

$$CO_2+C \rightarrow 2CO$$

$$MeO+CO \rightarrow Me+CO_2$$

In this sense, the agglomerate itself establishes, in practice, a semi-closed system in which the atmosphere is reducing during the period of time when there is available carbon inside. Alternatively, self-reducing agglomerates, such as the designation itself, maintain within inner part a reducing atmosphere that does not depend on the characteristics of the external atmosphere, that is, the type of atmosphere inside the stack furnace provided by the ascending gases.

Thus, it is possible to convert in energy for the process the CO present in the furnace atmosphere from the partial combustion of the fuel and the reduction reaction inside the self-reducing agglomerates.

On the other hand, in the melting processes in stack furnaces, the presence of coke or other solid fuel, charged at the top during the operation, travels downward with the rest of the filler, reacting with the $CO_2$, traveling upward, in countercurrent, according to Boudouard's reaction $CO_2+C \rightarrow 2CO$, thus increasing the consumption of carbonaceous material, without resulting in effective use in the reduction-melting process. If it were possible to burn this CO gas in the process itself, a higher efficiency would be achieved, resulting in savings in fuel coke in cupola furnaces and the fuel and reducer in blast furnaces, as in the case of all other stack furnaces used in the reduction/melting or only melting of any other alloys.

Document PI9403502-4, by the same Applicant, solves the above problem by providing a furnace comprising a fuel feed separate from the cargo inlet (raw material). In particular, the furnace described in the document PI9403502-4 shows an upper stack, which receives the filler (oxides/ores, for example) and a lower one, the fuel being inserted approximately at the junction between the two stacks.

Gases from the lower zone, in countercurrent with the filler, transfer to it the thermal energy required for heating and reduction or simple melting.

However, for the use of self-reducing agglomerates an adequate control of the gaseous flow is essential to allow the self reduction thereof in a homogeneous way. In spite of having numerous advantages, such as those mentioned above, the furnace described in the document PI9403502-4 does not have an adequate control of the gaseous flow in the upper stack allowing abrupt escape of gases in certain points of the furnace thus hindering the control of energy exchange between the gas and the filler in the upper stack.

Objectives of the Disclosure

One objective of the instant disclosure is to provide a metallurgical furnace for producing metal alloys by self-reduction of agglomerates having metal oxides, including the production of liquid iron, pig iron and cast iron, as well as metal alloys, allowing an adequate control of the gaseous flow and the energy exchange to allow the reduction of self-reducing agglomerates in a homogeneous way.

SUMMARY OF THE DISCLOSURE

In one embodiment, in order to achieve the above-described objectives, the instant disclosure provides a metallurgical furnace, comprising (i) at least one upper stack, (ii) at least one lower stack, (iii) at least one fuel feeder positioned substantially between at least one upper stack and the at least one lower stack, (iv) at least one row of tuyères positioned in at least one of the at least one upper stack and at least one lower stack, the at least one row of tuyères providing fluid communication between the inside of the furnace and the external environment, positioned in at least one of at least one upper stack and at least one lower stack, and further comprising (v) at least one permeabilizing fuel column fed through at least one hood extending longitudinally through the furnace.

DESCRIPTION OF THE FIGURES

The detailed description shown below refers to the attached figures, wherein.

DETAILED DESCRIPTION

This description starts with one embodiment of the disclosure. Nonetheless, the disclosure is not limited to this specific embodiment, as it will be evident for a person skilled in the art.

The instant disclosure provides a metallurgical furnace with innovations allowing an adequate control of the gaseous flow to enable the reduction of self-reducing agglomerates in a homogeneous way, also controlling the energy exchange between the gas and the filler, a fundamental principle of the self-reduction process.

Figure 1:
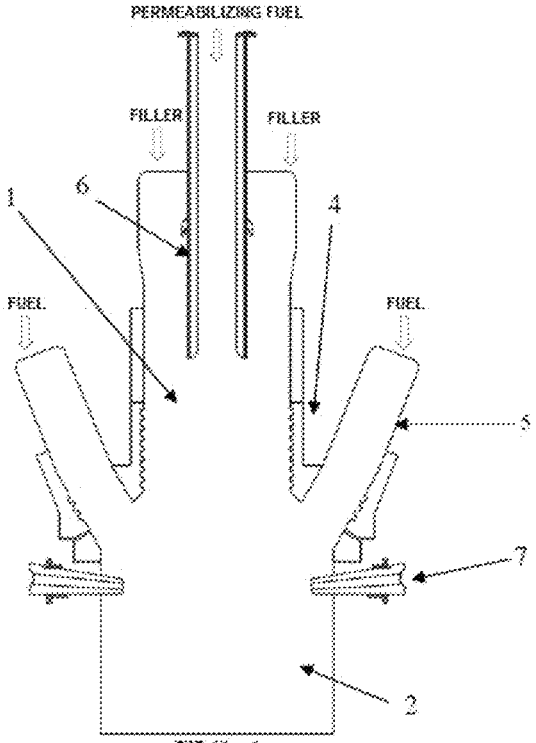
FIG. 1 shows a furnace with a hood according to one embodiment of the instant disclosure.

The metallurgical furnace of the instant disclosure is shown in FIG. 1, consisting essentially of an upper stack 1 where the filler (feedstock) is charged into the furnace. It is important to note that the stack may have a number of shapes such as, for example, a cylindrical shape having a circular cross-section, or a parallelepiped shape having a rectangular cross-section, inter alia. Hence, let us note that the instant disclosure is not limited to any specific shape of the furnace.

In the upper stack 1 there is an assembly of at least one row of secondary tuyères 4, which are preferably holes which allow blowing of hot or cold atmospheric air to burn CO and other combustible gases present in the ascending gas. The inflated air may optionally comprise $O_2$ enrichment. Moreover, gaseous, liquid or solid fuel can be injected into the tuyères 4 together with the blown air.

The furnace of the instant disclosure further comprises a lower stack 2, preferably of circular or rectangular cross-section, of sufficient diameter or dimensions for solid fuel feed. The diameter or width of the cross section of the stack 2 is greater than the one of the stack 1 sufficient for positioning fuel feeders. In the feeders, located around the junction of the upper stack 1 and the lower one 2, fuel supply ducts 5 may be coupled to ensure that the fuel filler goes into the bed of the furnace, avoiding occurrences of filler drag when using thin materials. As the filler falls on the feeder, preheating, pre-drying and distillation of the volatile fractions present in solid fuels and combustible carbonaceous residues occur.

The lower stack 2 has one or more rows of primary tuyères 3 which, as well as the secondary tuyères described above, serve to blow hot or cold air and can be enriched with $O_2$ or not. It is also possible to inject powder, liquid or gaseous solid fuels for partial combustion of the fuel, producing gas and providing the thermal energy necessary for the reduction and/or melting of the filler.

If hot air is blown in the primary and/or secondary tuyères 4, blower assemblies 7, which can be connected with any air heating system (not shown) known from the prior art, can be used.

Optionally, the lower stack 2 may have refractory lining and/or have refrigerated panels.

Furthermore, the furnace according to the instant disclosure comprises at least one permeabilizer fuel column fed through at least one hood extending longitudinally through the furnace, as shown in said FIG. 1. This hood 6, which can be a vertical duct positioned in the central vertical axis of the furnace, consists of an equipment that serves to channel the gas generated countercurrent with the flow of the filler, allowing a better control of the gas distribution of the entire upper stack 1. Therefore, the instant disclosure provides an excellent control of the energy exchange between the gas and the filler, enabling the reduction of self-reducing agglomerates homogeneously and generating gains of operational stability of the process.

Figure 2:
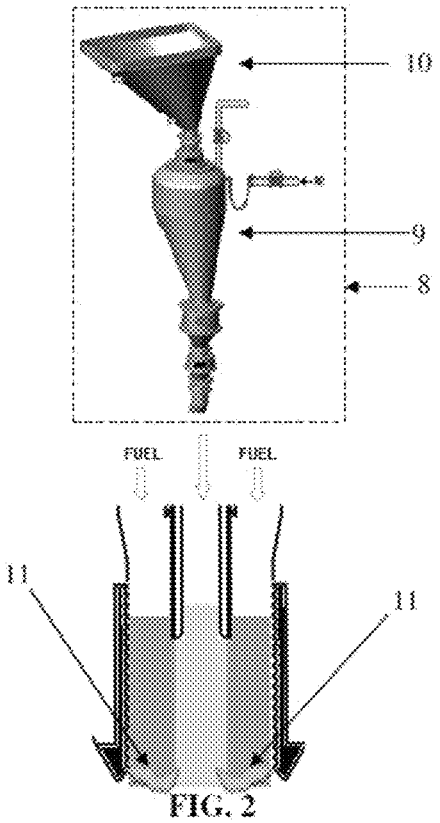
FIG. 2 shows a filler means according to one embodiment of the instant disclosure.

The hood 6 is placed on top of the upper stack 1 and extends longitudinally through the furnace, preferably being limited above the secondary tuyères 4. In one embodiment, the hood 6 preferably consists of a set of structured panels made of cast iron, steel or any other alloy, filled with refractory concrete and anchored in a sheet welded in the furnace structure. The hood 6 may also be fully or partially made of a refrigerated panel. During operation, part of the hood 6 is buried in the filler, forcing the passage of the generated gases both in the region of the primary tuyère 3 and in the region of the secondary tuyères 4, that is, the hood acts as a gas channeling It should be noted that there is a region, called the cohesion zone 11, where the softening and melting of the metallic filler occurs and, as a result, it is the zone of lower permeability, which considerably hinders gas passage. This difficulty in the passage of gas causes a preferential passage of the gas at specific points of the upper stack 1, making it impossible to control the gaseous flow and causing an irregular thermal exchange between the filler and the gas. The basic operating model provides for the placing of a volume of permeabilizing fuel as a fillher in the center, which not only provides thermal input, but also has the function of ensuring the passage of the gases in the cohesion zone 11, as shown in FIG. 2. When the metallic filler melts, it forms a zone of liquid and slurry material of very low permeability (cohesion zone 11). When a volume of the permeabilizing fuel is placed as a filler together with the metal charge in the upper part of the furnace, it allows the gases from the bottom vessel to reach the upper vessel easily. Thus, ideally the permeabilizer fuel is formed from at least one material which does not melt at internal temperatures of the metallurgical furnace, preferably the carbon base (C), such as, for example, metallurgical coke, petroleum coke, mineral coal, Charcoal, anthracite, briquette fuel, inter alia.

Moreover, a filler means 8 is provided to enable charging of the permeabilizing fuel into the furnace. Such filler means 8 may be preferably a simple system, for examples, containing an enclosed silo 9 and an open silo 10, with metering valves in the discharge of each silo; it may optionally have a pressure equalization system to enable the charging of the permeabilizer fuel from the closed silo into the furnace. The filler means 8 together with the hood 6 enables a channeling of the gas generated in the combustion of the fuel from the lower stack 2 with the air blown by the primary tuyères 3 and secondary tuyères 4, more efficiently controlling the gas distribution in the furnace.

Figure 3A:
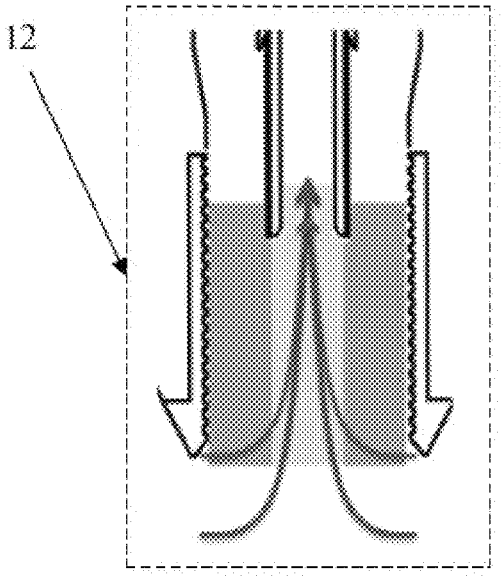
FIGS. 3A and 3B show the gaseous flow obtained by the instant disclosure in relation to the gas flow of the furnaces described in the prior art.
Figure 3B:
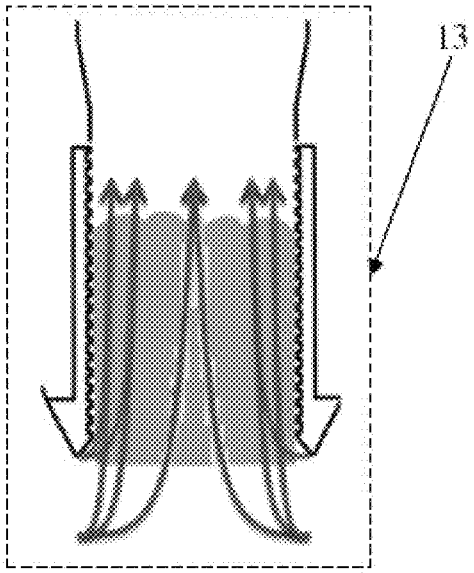

FIGS. 3A and 3B show the difference in the gaseous flow of the furnace 12 of the instant disclosure with respect to the gaseous flow of the furnace 13 described in the prior art document. It is noted that in the furnace of the instant disclosure there is a channeling of the gas generated due to the area of increased permeability formed by the permeabilizer fuel charge by the filler means 8. As mentioned above, this allows a greater control of the permeability of the upper stack 1, thus controlling the energy exchange between the gas and the filler, allowing the reduction of self-reducing agglomerates in a homogeneous way generating gains of operational stability of the process.

The configuration of the hood 6 defines the filler distribution in the furnace 12. Hence, the filler takes the dimensions imposed by it, that is, the width between the walls of the hood 6 is the width of the permeabilizing fuel column in the upper tub that will obey the dimensions and distances between the walls. During operation, part of the hood 6 is buried in the filler, forcing the passage of the generated gases both in the region of the primary tuyère 3 and in the region of the secondary tuyères 4, as shown in FIG. 5.

Thus, the furnace of the instant disclosure prevents the fuel from being fully charged with the filler at the top of the stack, therefore differing from the classical manufacturing processes and minimizing carbon gasification reactions (Boudouard's reactions) and increase both of the heat and fuel consumption in the furnace.

Furthermore, the furnace of the instant disclosure differs from the other prior art furnaces because permeabilizing fuel is used in small quantities in the top of the stack in order to obtain only a control of the permeability of the upper stack 1. In general, the use of this permeabilizing fuel does not affect the reduction and melting of the filler, since in this furnace self-reducing briquettes (but not just them) are used. In this case, the carbon required to reduce the filler is contained within the self-reducing briquette, thus not requiring that all the gas pass through the filler column as is the case of prior art conventional furnaces and in the classic manufacturing processes.

Countless variations affecting the scope of protection of this application are allowed. Therefore, it is to be emphasized that this invention is not limited to the specific configurations/embodiments described above.

The invention claimed is:

1. A metallurgic furnace comprising:

at least an upper stack;

at least a lower stack;

at least one fuel feeder positioned substantially between the at least one upper stack and the at least one lower stack;

at least one row of tuyères positioned in at least one of the at least one upper stack or the at least one lower stack, and at least a row of tuyères providing a fluid communication between the inside of the furnace and the external environment, positioned in the other of the at least one of the at least one upper stack or the at least one lower stack; and further comprising at least one permeabilizing fuel column extending longitudinally through the furnace fed by means of a hood extending longitudinally into the furnace.

2. The metallurgic furnace, according to claim 1, wherein the hood consists of a set of structured panels made of cast iron, steel or any other alloy, filled with refractory concrete and anchored in a sheet welded to the furnace structure.

3. The metallurgic furnace, according to claim 1 further comprising a filler silo system for delivering a permeabilizing material to and through the hood, wherein the filler silo system contains both an enclosed silo and an open silo.

4. The metallurgical furnace, according to claim 3, wherein the filler silo system comprises metering valves in respective discharges of the enclosed silo and the open silo.

5. The metallurgical furnace, according to claim 3, wherein the filler silo system comprises a pressure equalizing system.

6. The metallurgical furnace, according to claim 1, wherein the hood does not extend below either of the rows of tuyères.

7. The metallurgical furnace, according to claim 1, wherein the at least one permeabilizing fuel column and the hood allow gases from the lower stack to circulate to the upper stack.

* * * * *